US005087602A

United States Patent [19]

Matsushita et al.

[11] Patent Number: 5,087,602

[45] Date of Patent: Feb. 11, 1992

[54] RECORDING MATERIAL

[75] Inventors: Toshihiko Matsushita, Tokyo; Sadao Morishita, Ushiku, both of Japan

[73] Assignee: Mitsubishi Paper Mills Limited, Tokyo, Japan

[21] Appl. No.: 573,725

[22] Filed: Aug. 28, 1990

[30] Foreign Application Priority Data

Aug. 30, 1989 [JP] Japan ..... 1-224950

[51] Int. Cl.[5] ..... B41M 5/155

[52] U.S. Cl. ..... 503/216; 503/226

[58] Field of Search ..... 427/150–152; 503/216, 225

[56] References Cited

U.S. PATENT DOCUMENTS

| | | | |
|---|---|---|---|
| 3,244,549 | 4/1966 | Farnham et al. | 503/220 |
| 3,244,550 | 4/1966 | Farnham et al. | 503/216 |
| 3,539,375 | 11/1970 | Baum | 503/220 |
| 4,877,767 | 10/1989 | Liang et al. | 503/212 |

FOREIGN PATENT DOCUMENTS

| | | | |
|---|---|---|---|
| 49-10856 | 3/1974 | Japan | 503/225 |
| 58-16886 | 1/1983 | Japan | 430/138 |
| 60-168690 | 9/1985 | Japan | 503/200 |

*Primary Examiner*—Bruce H. Hess

*Attorney, Agent, or Firm*—Cushman, Darby & Cushman

[57] ABSTRACT

Disclosed is a recording material which comprises a normally colorless or palely colored dye precursor and a developer which causes the dye precursor to form color upon contact with the dye precursor, said developer being a copolymer of (A) a styrene monomer with (B) at least one monomer selected from the group consisting of a vinylsulfonic acid type monomer, a (meth)acrylic type phosphorous-containing monomer and a (meth)acrylic acid type monomer. This recording material is excellent in stability of color image portion and non-image portion.

7 Claims, No Drawings

RECORDING MATERIAL

BACKGROUND OF THE INVENTION

The present invention relates to a recording material and in particular to a recording material superior in stability of color imaged portion and unimaged portion.

Recording materials which use a developer which contacts with a normally colorless or palely colored dye precursor to cause the dye precursor to form color are known and widely used as pressure-sensitive recording sheets, photosensitive pressure-sensitive recording sheets, heat-sensitive recording sheets, electro heat-sensitive recording sheets, heat-sensitive transfer sheets, and the like. For example, pressure-sensitive recording sheets are disclosed in Japanese Patent Kokai (Laid-Open) No. 58-217389 and Japanese Patent Kokoku (Post Exam. Publication) Nos. 40-9309, 49-10856 and 52-1327, photosensitive pressure sensitive recording sheets are disclosed in Japanese Patent Kokai (Laid-Open) Nos. 58-16886 and 58-17432, heat-sensitive recording sheets are disclosed in Japanese Patent Kokai (Laid-Open) No. 48-30944 and Japanese Patent Kokoku (Post Exam. Publication) No. 45-14039, electro heat-sensitive recording sheets are disclosed in Japanese Patent Kokoku (Post Exam. Publication) No. 52-44206 and heat-sensitive transfer sheets are disclosed in Japanese Patent Kokai (Laid-Open) No. 60-168690.

In these recording materials, inorganic solid acids, semi-synthetic solid acids, substituted phenols, p-substituted phenol-formaldehyde polymers, metal salts of aromatic carboxylic acids and the like are used as developers which contact with normally colorless or palely colored dye precursor to cause the dye precursor to form color.

Requirements which recording materials should satisfy are sufficient color density and color sensitivity and besides, excellent stability of imaged portion and unimaged portion, especially high light resistance, water resistance and chemical resistance are also essential requirements to be satisfied. The above-exemplified developers have both merits and demerits in their properties.

For example, inorganic solid acids and semi-synthetic solid acids are inexpensive, but adsorb gas or water in the air in storage to bring about yellowing of coated surface or deterioration in color formation properties. Furthermore, exposure to light such as sun light causes deterioration of color image. Substituted phenols is inferior in color forming properties and result in low density of image. p-Substituted phenol-formaldehyde polymers are excellent in color formation properties, but upon exposure to light such as sun light or adsorption of NOx in the air, coated surface is yellowed and color image is also deteriorated. Metal salts of aromatic carboxylic acids are superior in color formation and light resistance and cause less yellowing, but still suffer from the problems in water resistance and chemical resistance.

Especially, chemical resistance is an important requirement for recording materials. When a sheet on which colored record image is formed is stored in a file made of polyvinyl chloride film or the like, plasticizers in the polyvinyl chloride film cause deterioration (discoloration) of image. Further, when the sheet contacts with office supplies such as writing utensils of water or oil ink, vermilion ink pad, adhesives, and diazo developers, and cosmetics such as hand cream and milky lotion, the coated surface (white portion) forms color (so-called fogging phenomenon) and the image area fades in color.

Thus, conventional developers still have problems to be improved and novel developers free from these problems have been demanded.

SUMMARY OF THE INVENTION

The object of the present invention is to provide a recording material excellent in stability of image portion and background portion.

According to the present invention, a recording material is provided which comprises a normally colorless or palely colored dye precursor and a developer which contacts with said dye precursor to cause the dye precursor to form color, said developer being a copolymer of (A) a styrene monomer and (B) at least one monomer selected from the group consisting of a vinylsulfonic acid type monomer, a (meth)acrylic type phosphorus-containing monomer and a (meth)acrylic acid type monomer.

Furthermore, the developer is characterized in that the copolymer is prepared by polymerizing 100% by weight of monomer (A) and 15–150% by weight, preferably 20–125% by weight, more preferably 25–100% by weight of monomer (B) based on the weight of monomer (A).

DETAILED DESCRIPTION OF THE INVENTION

The present invention will be explained in detail.

The developer in the present invention is obtained by copolymerization, terpolymerization or four or more-component polymerization of a styrene monomer and a functional monomer or monomers.

The functional monomers include especially vinylsulfonic acid type monomers, (meth)acrylic type phosphorus-containing monomers and (meth)acrylic acid type monomers. As examples of the vinylsulfonic acid type monomers, mention may be made of sodium styrenesulfonate, potassium styrenesulfonate, and lithium styrenesulfonate. As examples of the (meth)acrylic type phosphorus-containing monomers, mention may be made of mono-2-(meth)acryloxyethyl acid phosphate, mono-2-(meth)acryloxypropyl acid phosphate, mono-3-chloro-2-(meth)acryloxyethyl acid phosphate, mono-3-chloro-2-(meth)acryloxypropyl acid phosphate, and bis(methacryloyloxyethyleneoxycarbonylpentamethylene)acid phosphate. The (meth)acrylic acid type monomers include (meth)acrylic acid and derivatives thereof and as examples thereof, mention may be made of (meth)acrylic acid, 2-hydroethyl methacrylate, 2-hydroxypropyl methacrylate, dimethylaminoethyl methacrylate, diethylaminoethyl methacrylate, ethylene glycol dimethacrylate, diethylene glycol dimethacrylate, trimethylolpropane trimethacrylate, 1,6-hexanediol dimethacrylate, 2-methacryloyloxyethylsuccinic acid, 2-methacryloyloxyethylphthalic acid, and glycidyl methacrylate.

The developer of the present invention is in the form of polymer latex synthesized using the above monomers by emulsion polymerization method. The emulsion polymerization method employed in the present invention is not one which uses emulsifiers, but one which uses no emulsifiers. The polymerization reaction is carried out by using no emulsifier other than using potassium persulfate as a polymerization initiator and is well known to be used for synthesis of polystyrene latex.

In the present invention, a novel developer comprising polymer latex can be obtained by copolymerizing a styrene monomer with at least one monomer having a functional group which contacts with a normally colorless or palely colored dye precursor to bring about color formation reaction. This novel developer when coated on a support is excellent in water resistance because of its film-formability. Furthermore, it is a stable polymer latex and so has excellent resistances to light, gas (NOx), chemicals and the like. In addition, it also possesses function as a binder, which is the property of polymer latex per se.

In copolymerization reaction of (A) a styrene monomer with (B) at least one of a vinylsulfonic acid type monomer, a (meth)acrylic type phosphorus-containing monomer and a (meth)acrylic acid type monomer, weight ratio of the monomers is such that monomer (B) is in an amount of 15–150% by weight, preferably 20–125% by weight, more preferably 25–100% by weight per monomer (A).

Amount of the developer to be used may vary depending on kind of recording materials, but coating amount thereof is generally 0.2–10 g/m$^2$, preferably 0.3–7.5 g/m$^2$, more preferably 0.5–5 g/m$^2$. When coating amount is less than 0.2 g/m$^2$, color developability cannot be obtained and use of more than 10 g/m$^2$ is not economical though there are no problems in developability.

The developer of the present invention may be used singly, but may be combined with pigments, binders, known developers and other additives depending on the kind of desired recording materials.

Examples of recording materials in which the developer of the present invention is used are pressure-sensitive recording papers and heat-sensitive recording papers. Common dye precursors may be used in these recording materials. Examples of the dye precursors are triarylmethane compounds such as 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-phenylindol-3-yl)phthalide, and 3,3-bis(9-ethylcarbazole-3-yl)-5-dimethylaminophthalide; dimethylmethane compounds such as 4,4'-bisdimethylaminobenzhydrinbenzyl ether, N-halophenylleucoauramine, and N-2,4,5-trichlorophenylleucoauramine; xanthene compounds such as Rhodamine B-anilinolactam, 3-dimethylamino-7-methoxyfluoran, 3-diethylamino-7-chlorofluoran, 3-diethylamino-6,8-dimethylfluoran, 3-diethylaminofluoran, 3,7-diethylaminofluoran, 3-diethylamino-7-dibenzylaminofluoran; and 3-diethylaminochloroethylmethylaminofluoran, thiazine compounds such as benzoyl leucomethylene blue and p-nitrobenzyl leuco methylene blue; and spiro compounds such as 3-ethylspirodinaphthopyrane, 3,3'-dichlorospirodinaphthopyrane, and 3-propyldibenzopyrane.

The developer of the present invention may be used in combination with known developers. For example, for pressure-sensitive recording sheets, there may be used inorganic acidic substances such as acid clay, activated clay, kaolin, zeolite, bentonite, and attapulgite; phenolic developers such as substituted phenol, phenol-formaldehyde resin, alkyl-substituted phenol-formaldehyde resin, and aryl-formaldehyde resin and metallic salts thereof; and salicylic acid type developers such as benzoic acid, chlorobenzoic acid, toluylic acid, salicylic acid, 5-tert-butylsalicylic acid, 3,5-di-tert-butylsalicylic acid, and 3,5-di(α-methylbenzyl)salicylic acid and metallic salts thereof. Furthermore, for heat-sensitive recording sheets, there may be used, for example, phenol, p-tert-butylphenol, p-phenylphenol, α-naphthol, p-hydroxyacetophenol, 2,2'-dihydroxydiphenol, 4,4'-isopropylidenebis(2-tert-butylphenol), 4,4'-isopropylidenediphenol, 4,4'-cyclohexylidenediphenol, novolak type phenol resin, benzoic acid, p-tert-butylbenzoic acid, p-hydroxybenzoic acid, benzyl p-hydroxybenzoate, methyl p-hydroxybenzoate, 3-benzyl-4-hydroxybenzoic acid, β-naphthoic acid, salicylic acid, 3-tert-butylsalicylic acid, 3-methyl-5-tert-butylsalicylic acid, stearic acid, oxalic acid, and maleic acid.

These exemplified developers are not limited by uses of recording sheets, but can be suitably used.

Pigments, binders and other additives may be optionally used in recording materials. As pigments, mention may be made of, for example, barium sulfate, calcium carbonate, barium carbonate, aluminum hydroxide, precipitating calcium carbonate, gypsum, asbestos, clay, silica, finely divided silicic acid, diatomaceous earth, talc, basic magnesium carbonate, alumina white, gloss white, satin white, zinc white, white lead, basic sulfates, lithopone, zinc sulfide, titanium oxide, antimony oxide, barytes, mica, ochre, calcium silicate, synthetic calcium carbonate, and magnesium carbonate. As binders, mention may be made of, for example, gelatin, casein, carboxymethyl cellulose, carboxymethyl starch, gum arabic, polyvinyl alcohol, polyvinyl pyrrolidone, polyacrylic acid, styrene-butadiene-methacrylic acid latex, acrylonitrile-butadiene-acrylic acid latex, and styrene-maleic anhydride copolymer.

Papers, synthetic papers and films are used as a substrate for recording materials. As coating method, those which are generally employed by one skilled in the art can be employed. For example, air coater, roll coater, size press coater, curtain coater, gravure coater, and the like can be suitably employed.

The recording materials of the present invention have excellent image stability. This is because the novel developer is a polymer latex comprising a copolymer of monomers having acidic functional groups such as carboxylic acid, sulfonic acid and phosphoric acid and hence is not influenced by external factors (water, NOx gas, chemicals, light, etc.). The novel developer coated on a support has film-formability and so is not readily attacked by external factors. It is considered that for these reasons, the novel developer of the present invention has effects not seen in the conventional developers.

DESCRIPTION OF PREFERRED EMBODIMENTS OF THE INVENTION

The present invention will be explained in more detail by the following examples.

EXAMPLE 1

(1) Preparation of developer

A four-necked flask equipped with a stirrer, a reflux condenser, a thermometer, and a blowing pipe for introduction of nitrogen gas was provided in an oil bath and the following monomers, water and polymerization initiator (potassium persulfate) were charged therein in this order and nitrogen gas was blown thereinto for 1.5 hour with stirring.

| | |
|---|---|
| 1. Styrene monomer | 48 parts by weight |
| 2. Mono-3-chloro-2-methacryloxyethyl acid phosphate | 25 parts by weight |
| 3. Water | 75 parts by weight |
| 4. Potassium persulfate | 2 parts by weight |

After well stirring, temperature in the flask was raised to 70° C. over a period 1 hour with stirring. After the temperature reached 70° C., the flask was kept at 70° C. and reaction was allowed to proceed for 24 hours. Then, stirring rate was gradually lowered and reaction was completed. The four-necked flask was once air-cooled and water-cooled to room temperature. The resulting latex had a solid concentration of 50% by weight.

(2) Production of lower paper for pressure-sensitive recording paper

The developer obtained above was coated alone on a woodfree paper of 41 g/m$^2$ by Meyer bar. Coating amount was 2 g/m$^2$ in terms of solid content.

The thus obtained lower paper was subjected to the following various evaluation tests and the results are shown in Table 1.

As Comparative Example 1, commercially available lower paper for pressure-sensitive paper (MITSUBISHI NCR Lower Paper-40) was used.

(a) Color formation test

A commercially available upper paper for pressure-sensitive recording paper (MITSUBISHI NCR Upper Paper-40 Black) was superposed on the lower paper and color was formed by application of pressure of 10 kg/cm$^2$ using super calender. Color density after 24 hours was measured by an optical densitometer (Macbeth densitometer RD514). The higher value means the higher color density.

(b) Light resistance test

The same sample on which color was formed as obtained in the above (a) was irradiated with xenon light for 3 hours by fadeometer. Density of the sample after subjected to irradiation was measured in the same manner as in the above (a). The higher value means the superior light resistance.

(c) Plasticizer resistance test

The same sample on which color was formed as obtained in the above (a) was put in a bag of polyvinyl chloride (thickness 0.2 mm) and stored at 60° C. for 24 hours to expose the sample to plasticizer contained in polyvinyl chloride. Density of the sample after storing was measured in the same manner as in the above (a). The higher value means the superior plasticizer resistance.

(d) Test on light resistance of the portion where no color was formed (background)

The portion was irradiated with xenon lamp for 3 hours in the same manner as in the above (b) and degree of discoloration (yellowing) was evaluated by measuring density by optical densitometer. The higher value means that yellowing was advanced and the lower value means the higher light resistance.

(e) Test on resistance to yellowing due to nitrogen compound (NOx gas)

A lower sheet of pressure-sensitive sheet which had not been subjected to color formation was put in a container containing 150 ppm of nitrogen compound and the container was closed and left to stand for 30 minutes. Then, degree of yellowing was measured by optical densitometer. The higher value means that yellowing was advanced and the lower value means the higher light resistance.

TABLE 1

| Items of evaluation | Example 1 | Comparative Example 1 |
|---|---|---|
| Portion where color was formed | | |
| Color density | 0.65 | 0.62 |
| Light resistance | 0.62 | 0.50 |
| Plasticizer resistance | 0.65 | 0.25 |
| Portion where no color was formed | | |
| Light resistance | 0.12 | 0.23 |
| Resistance to yellowing due to NOx | 0.11 | 0.26 |
| Density (background) | 0.10 | 0.10 |

*Lower paper of Comparative Example 1 contained p-phenylphenol resin as developer.

From the results in Table 1, it can be seen that in Example 1 the portion of the sample where color was formed showed no discoloration in the tests for light resistance and plasticizer resistance and density of the portion where no color was formed and which was subjected to test on light resistance and resistance to yellowing due to nitrogen compound was nearly the same as density (background density) of the portion where no color was formed and which was not subjected to the tests and thus, the sample was high in the resistances. Furthermore, when lower sheet in which the developer of the present invention was used was crumpled, coating layer did not peel off. From this result, it can be seen that the developer per se has the function as a binder and so other binder is not required.

On the other hand, in Comparative Example 1, the sample subjected to color formation showed discoloration in both the light resistance test and plasticizer resistance test and density of the portion of the sample where no color was formed was higher in light resistance test and test on resistance to yellowing due to nitrogen compound than the portion where no color was formed and which was not subjected to the tests (density of background) and thus this portion showed change of color.

EXAMPLES 2-6 AND COMPARATIVE EXAMPLES 2-3

Copolymerization was carried out in the same manner as in Example 1 using the same monomers as in Example 1. Amounts of the monomers used are shown in Table 2. Amounts of water of 75 parts by weight and of potassium persulfate of 2 parts by weight were kept constant. The developers obtained here were coated in the same amounts and evaluated in the same manner as in Example 1 and the results are also shown in Table 2. The results were superior in respective test items in Examples 2-6. However, when amount of mono-3-chloro-2-methacryloxyethyl acid phosphate (referred to as "phosphorus-containing acrylic monomer") was large, color density increased, but light resistance and resistance to yellowing due to nitrogen compound of the portion where no color was formed slightly decreased. Density of color in plasticizer resistance test was higher than color density in color formation test. On the other hand, color density in color formation test was low in Comparative Example 2. It is considered that this is because amount of the phosphorus-containing acrylic monomer was small. In Comparative Example 3, the developer became gelatinous during preparation.

TABLE 2

| | Monomer ratio (A) Styrene monomer/ (B) Acrylic phosphor-containing monomer | Amount of monomer used (part by weight) | | Portion where color was formed | | | Portion where no color was formed | | |
|---|---|---|---|---|---|---|---|---|---|
| | | Monomer (A) | Monomer (B) | Color density | Light resistance | Plasticizer resistance | Light resistance | Resistance to yellowing due to NOx | Density (background) |
| Example 2 | 100/15 | 63.5 | 9.5 | 0.60 | 0.56 | 0.58 | 0.11 | 0.11 | 0.10 |
| Example 3 | 100/75 | 42 | 31 | 0.66 | 0.65 | 0.66 | 0.11 | 0.11 | 0.10 |
| Example 4 | 100/100 | 36.5 | 36.5 | 0.66 | 0.66 | 0.66 | 0.11 | 0.11 | 0.10 |
| Example 5 | 100/125 | 32 | 41 | 0.70 | 0.70 | 0.71 | 0.12 | 0.11 | 0.11 |
| Example 6 | 100/150 | 29.2 | 43.8 | 0.73 | 0.73 | 0.75 | 0.13 | 0.12 | 0.11 |
| Comparative Example 2 | 100/14 | 64 | 9 | 0.55 | 0.50 | 0.45 | 0.11 | 0.11 | 0.11 |
| Comparative Example 3 | 100/155 | 28.6 | 44.4 | — | — | — | — | — | — |

EXAMPLE 7

A terpolymer was obtained by copolymerizing the following monomers in the same manner as in Example 1. Charging order of the monomers was as shown by the number.

| | Parts by weight |
|---|---|
| (1) Styrene monomer | 36.5 |
| (2) Mono-2-methacryloxypropyl acid phosphate | 18.25 |
| (3) Acrylic acid | 18.25 |
| (4) Water | 75.0 |
| (5) Potassium persulfate | 2.0 |

A coating liquid was prepared using the resulting developer by the following formulation and was coated on a woodfree paper of 41 g/m$^2$ at a coating amount of 3 g/m$^2$ (solid content) by a Meyer bar.

The obtained lower paper was evaluated in the same manner as in Example 1 and the results are shown in Table 3.

| | Parts by weight |
|---|---|
| Developer | 60 |
| Aluminum hydroxide | 35 |
| Polyvinyl alcohol | 5 |

Results of evaluation were superior in all items.

EXAMPLE 8

A terpolymer was obtained by copolymerizing the following monomers in the same manner as in Example 1. Charging order of the monomers was as shown by the number.

| | Parts by weight |
|---|---|
| (1) Styrene monomer | 36.5 |
| (2) Mono-2-methacryloxypropyl acid phosphate | 29.2 |

-continued

| | Parts by weight |
|---|---|
| (3) Sodium styrenesulfonate | 7.3 |
| (4) Water | 75.0 |
| (5) Potassium persulfate | 2.0 |

A coating liquid was prepared using the resulting developer by the following formulation and was coated on a woodfree paper of 41 g/m$^2$ at a coating amount of 3 g/m$^2$ (solid content) by a Meyer bar.

The obtained lower sheet was evaluated in the same manner as in Example 1 and the results are shown in Table 3.

| | Parts by weight |
|---|---|
| Developer | 50 |
| Calcium carbonate | 40 |
| Polyvinyl alcohol | 10 |

Results of evaluation were superior in all items.

TABLE 3

| Items of evaluation | Example 7 | Example 8 |
|---|---|---|
| Portion where color was formed | | |
| Color density | 0.63 | 0.67 |
| Light resistance | 0.60 | 0.65 |
| Plasticizer resistance | 0.62 | 0.66 |
| Portion where no color was formed | | |
| Light resistance | 0.11 | 0.11 |
| Resistance to yellowing due to NOx | 0.10 | 0.11 |
| Density (background) | 0.10 | 0.10 |

EXAMPLE 9

A coating liquid for a heat-sensitive recording paper of the following composition was prepared using the developer obtained by polymerization in the same manner as in Example 7. Dye precursor (hereinafter referred to as "dye") in the composition was previously dispersed and used.

Dispersion of dye:

150 g of a dye comprising 3-diethylamino-6-methyl-7-anilinofluoran was dispersed in 18 g of MALON MS-25 (25% aqueous solution of sodium salt of styrenemaleic anhydride copolymer; manufactured by Daido Kogyo K.K.) and 332 g of water and the dispersion was milled in ball mill for 48 hours to prepare a dispersion of dye.

Composition of coating liquid (solid content):

| | Parts by weight |
|---|---|
| Developer | 25 |
| Dye dispersion | 10 |
| Calcium carbonate | 30 |
| Zinc stearate | 25 |
| Polyvinyl alcohol | 10 |

The coating liquid for a heat-sensitive recording paper which was prepared above was coated on a base paper of 55 g/m$^2$ at a coating amount of 6 g/m$^2$ (solid content) by Meyer bar. The paper coated above was treated by super calender to obtain a heat-sensitive recording paper. The recording sheet was subjected to the following evaluation tests and the results are shown in Table 4.

(a) Color formation test

Solid color image was formed at printing pulse 3.0 msec and applied voltage 16.25 volts by a heat-sensitive facsimile printing tester (manufactured by Matsushita Electronic Parts Co.) and density of the resulting image was measured by Macbeth densitometer RD514.

(b) Plasticizer resistance test

A sheet of polyvinyl chloride (0.2 mm thick) was superposed on the coating layer of the heat-sensitive recording paper and kept at 40° C. for 15 hours under application of load of 300 g/m$^2$ and density of the color image portion and non-image portion was measured as in the above (a). The smaller value of the non-image portion means less fogging of backgrounds.

COMPARATIVE EXAMPLE 4

A heat-sensitive recording paper was prepared in the same manner as in Example 9 except that 2,2-bis(4-hydroxyphenyl)propane was used in place of the developer used in Example 9. This recording sheet was evaluated as in Example 9 and the results are shown in Table 4.

TABLE 4

| Items of evaluation | Example 9 | Comparative Example 4 |
|---|---|---|
| | Color image portion | |
| Color density | 1.20 | 1.15 |
| Plasticizer resistance | 1.18 | 0.76 |
| | Non-image portion | |
| Density of background | 0.09 | 0.08 |
| Plasticizer resistance | 0.10 | 0.37 |

As is clear from the results of Table 4, in Example 9 the density of the color image portion in plasticizer resistance test was nearly the same as the density of the color image portion in color formation test. Furthermore, in non-image portion, also the density thereof in plasticizer resistance test was nearly the same as the density of background which was not subjected to the plasticizer resistance test. On the other hand, in Comparative Example 4, the density of color image portion in plasticizer resistance test was lower than the density of the color image portion in color formation test and it was seen that the color image was discolored by plasticizer. In non-image portion, the density in plasticizer resistance test was higher than the density of background and it was seen that fogging occurred in the background.

A developer comprising a copolymer prepared by polymerizing (A) a styrene monomer with (B) at least one of a vinylsulfonic acid monomer, a phosphorus-containing (meth)acrylic acid monomer and a (meth}acrylic acid monomer is used in the recording material of the present invention. The recording material in which this novel developer is used is highly stable in color image portion and non-image portion. Further, the developer has the characteristic that since the developer per se is a polymer latex, it also has a function as a binder and thus the recording material of the present invention is very high in practical value.

What is claimed is:

1. A recording material which comprises a normally colorless or palely colored dye precursor and a developer which causes the dye precursor to form color upon contact with the dye precursor, said developer being a copolymer of (A) a styrene monomer with (B) at least one monomer selected from the group consisting of a vinylsulfonic acid monomer, a (meth)acrylic phosphorus-containing monomer and a (meth)acrylic acid monomer.

2. A recording material according to claim 1, wherein the developer is a copolymer which comprises 15–150% by weight of (B) at least one monomer selected from the group consisting of vinylsulfonic acid monomer, (meth)acrylic phosphorus-containing monomer and (meth)acrylic acid monomer based on the weight of (A) styrene monomer.

3. A recording material according to claim 1, wherein the developer is a copolymer which comprises 20–125% by weight of (B) at least one monomer selected from the group consisting of vinylsulfonic acid monomer, (meth)acrylic phosphorus-containing monomer and (meth)acrylic acid monomer based on the weight of (A) styrene monomer.

4. A recording material according to claim 1, wherein the developer is a copolymer which comprises 25–100% by weight of (B) at least one monomer selected from the group consisting of vinylsulfonic acid monomer, (meth)acrylic phosphorus-containing monomer and (meth)acrylic acid monomer based on the weight of (A) styrene monomer.

5. A recording material according to claim 1, wherein the vinylsulfonic acid monomer is a monomer selected from the group consisting of sodium styrene-sulfonate, potassium styrenesulfonate and lithium styrenesulfonate.

6. A recording material according to claim 1, wherein the (meth)acrylic phosphorus-containing monomer is a monomer selected from the group consisting of mono-2-(meth)acryloxyethyl acid phosphate, mono-2-(meth)acryloxypropyl acid phosphate, mono-3-chloro-2-(meth-)acryloxyethyl acid phosphate, mono-3-chloro-2(meth-)acryloxypropyl acid phosphate, and bis(methacryloyloxyethyleneoxycarbonylpentamethylene) acid phosphate.

7. A recording material according to claim 1, wherein the (meth)acrylic acid monomer is (meth)acrylic acid or a derivative thereof which is selected from the group consisting of (meth)acrylic acid, 2-hydroxyethyl methacrylate, 2-hydroxypropyl methacrylate, dimethylaminoethyl methacrylate, diethylaminoethyl methacrylate, ethylene glycol dimethacrylate, diethylene glycol dimethacrylate, trimethylolpropane trimethacrylate, 1,6-hexanediol dimethacrylate, 2-methacryloyloxyethylsuccinic acid, 2-methacryloyloxyethylphthalic acid and glycidyl methacrylate.

* * * * *